US006347868B1

(12) United States Patent
Headrick et al.

(10) Patent No.: US 6,347,868 B1
(45) Date of Patent: Feb. 19, 2002

(54) HAND HELD INK JET PAINTING TOOL

(75) Inventors: Charles R. Headrick, Corvallis, OR (US); Eric T. Martin, Provo, UT (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/451,508

(22) Filed: Nov. 30, 1999

(51) Int. Cl.[7] ..... B41J 3/36
(52) U.S. Cl. ..... 347/109
(58) Field of Search ..... 347/9, 12, 43, 347/49, 54, 109, 68; 400/88; 401/195

(56) References Cited

U.S. PATENT DOCUMENTS 4,412,232 A 10/1983 Weber et al. ..... 347/68
4,758,849 A * 7/1988 Piatt et al. ..... 347/9
5,501,535 A * 3/1996 Hastings et al. ..... 400/88
5,911,533 A * 6/1999 Fassler et al. ..... 401/195
5,953,497 A * 9/1999 Kokubo et al. ..... 347/109

FOREIGN PATENT DOCUMENTS

JP 4-141463 * 5/1992 ..... B41J/2/525

* cited by examiner

*Primary Examiner*—Hai C. Pham

(57) ABSTRACT

A painting tool with a carriage having a control switch, control circuitry, and an ink jet pen connected to the carriage and control circuitry. An ink jet pen may be included in the carriage, and more than one switch may be provided, with one switch controlling hue, and the other controlling flow rate. An on-board power source may be included to provide cordless operation.

1 Claim, 3 Drawing Sheets

HAND HELD INK JET PAINTING TOOL

FIELD OF THE INVENTION

This invention relates to artists' painting tools, and more particularly to hand held tools such as air brushes.

BACKGROUND AND SUMMARY OF THE INVENTION

Air brushes are used by artists to generate effects having soft or blurry features that may be readily blended, and which allow subtle gradations of hue and value. Air brush systems, while useful, are unsuitable for non-professionals seeking to generate similar images, and to engage in recreational creative arts. Air brush systems are relatively expensive, particularly in that they require an air compressor not already found in most households. In addition, the compressor requires an air line that tethers the user to a limited area. Also, air compressors are noisy, creating an unpleasant environment for creative expression. Professional air brushes also require attention to cleaning and service to ensure continued operation. An air brush is capable of emitting only a single color at one time, requiring flushing out of one color paint before beginning with another paint color.

Ink jet printers provide strictly controlled operation of an ink jet pen that ejects ink droplets through small nozzles toward a sheet of printer media. Such printers maintain the pen at a fixed distance from the media, and control the motion of the pen to a straight swath to ensure that droplets are distributed in a controlled raster or grid pattern. Electronic circuitry on a pen controls various parameters, such as print head die temperature, to ensure that droplet volume is consistent over a wide range of environmental conditions, ensuring uniform printing. Occasionally during the production of ink jet pens, a pen is rejected as unsuitable for the critical function of printing. Such a rejected pen might operate adequately, except that the temperature control circuitry is inoperable, allowing droplet size to depart from strict constraints required for printing uniformity. In other instances, a single ink nozzle out of the several hundred nozzles might be clogged or otherwise inoperable, which would cause a defect in some printer output. These rejected pens, while few in comparison to the multitudes successfully produced to strict standards for printers, lack any useful application and must be discarded at significant cost to the manufacturer.

The present invention overcomes the limitations of the prior art by providing a painting tool with a carriage having a control switch, control circuitry, and means to connect an ink jet pen to the carriage and control circuitry. An ink jet pen may be included in the carriage, and more than one switch may be provided, with one switch controlling hue, and the other controlling flow rate. An on-board power source may be included to provide cordless operation.

DETAILED DESCRIPTION OF A PREFERRED EMBODIMENT

Figure 1:
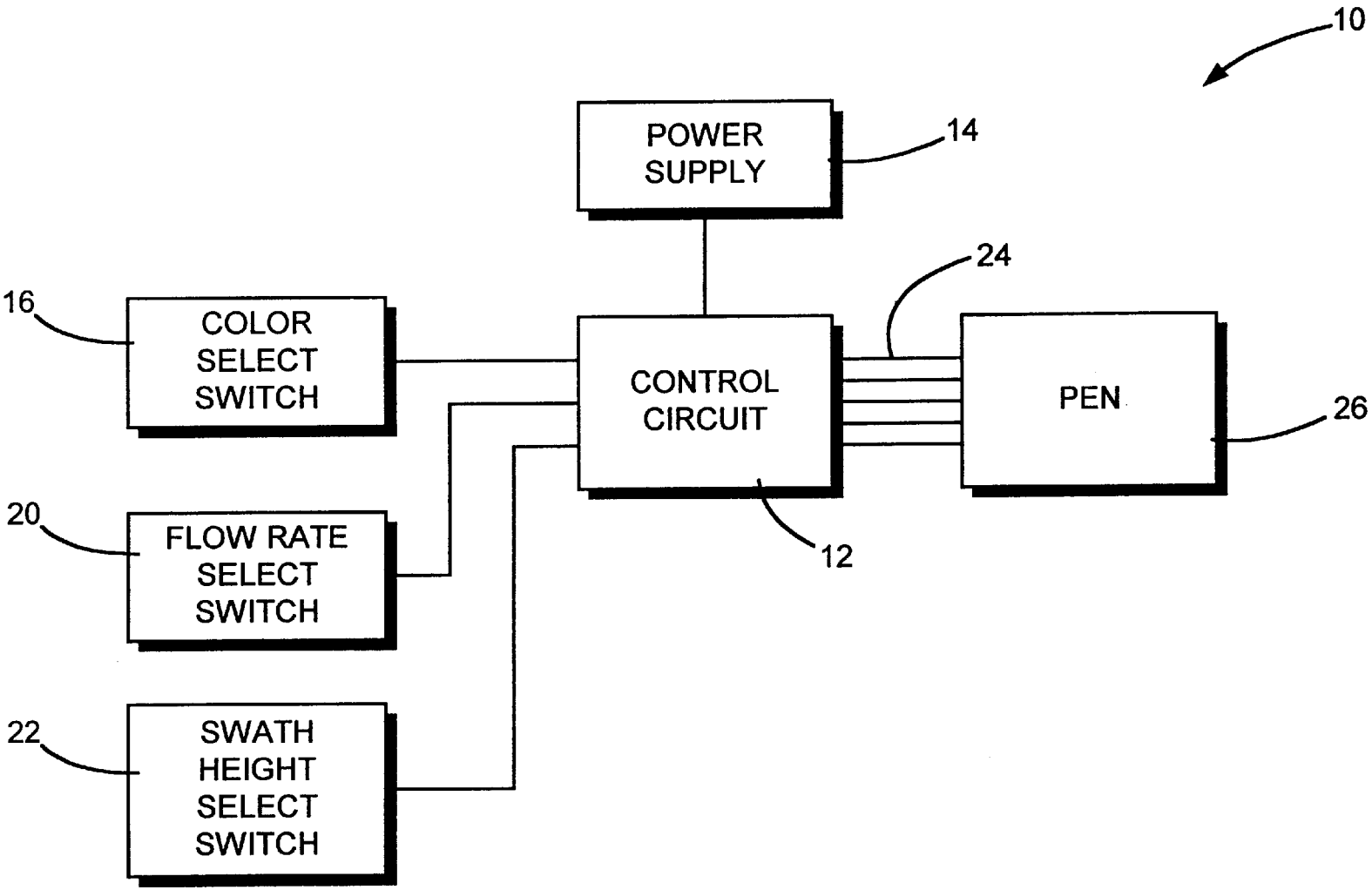
FIG. 1 is block diagram of a printing tool circuit according to a preferred embodiment of the invention.

FIG. 1 shows a block diagram of an electronic painting apparatus 10. The apparatus has a control circuit 12 that is connected to each of the other functional components. A power supply 14 such as a battery pack provides power to the control circuit, which is preferably a micro controller that is programmed to operate an ink jet print head in response to control inputs. Three switches provide control inputs to the control circuit. A color select switch 16, a flow rate select switch 20, and a swath height select switch 22 each are independently connected to the control circuit. In alternative embodiments, different switches may be employed to achieve different functions. A multi-line pen control bus 24 provides electronic communication to a color ink jet pen 26, preferably containing cyan, magenta, and yellow printing inks. In alternative embodiments, any color or combination of colors may be employed, although the preferred embodiment uses a multi-color ink system capable of generating a full spectrum of composite ink colors. In the preferred embodiment, the control bus has 16 lines, with the pen operating in a multiplexed manner to provide individual addressability of its several hundred ink jet nozzles. The micro-controller may operate essentially the same as a conventional controller for a printer, although its operation may be simplified due to the fact that the preferred embodiment operates to print solid swaths of a single selected color at a time, without the need to address individual nozzles, or to change which nozzles are operating from moment to moment. Thus, the controller may be programmed with simpler software, within the knowledge of one skilled in the art of conventionally controlling ink jet pens for printing.

The color select switch is preferably a rotary switch having a range of positions, each corresponding to a color within the range of colors that may be printed by the pen. A digital position encoder may send a digital code indicating the color to be printed, or an analog device may provide a voltage or resistance from within a continuous range to indicate the desired color. In the preferred embodiment of a three color pen, the switch may have six discrete positions, each indicating a primary or secondary color formed either by one ink color, or a combination of two colors. A seventh position may indicate a black printing color generated by simultaneous printing of all three ink colors.

In a more complex alternative embodiment, the color select switch may be continuously variable, to allow any hue from within the possible range to be selected, or may have more numerous discrete settings for a greater variety of more subtle color options. This provides selection of a range of saturated colors. However, another alternative embodiment may include a second color select switch, or a second degree of freedom of the switch to provide saturation control. That is, instead of indicating the proportions of one or two colors, the switch has a saturation control that indicates the proportion of the third color, allowing colors in muted or selectably grayed shades in the range between fully saturated and composite black.

The flow rate select switch 20 preferably allows a range of inputs to be communicated, from a fully-off released position, to a fully-actuated position in which printing occurs at a maximum rate. The switch may provide a continuous range of positions, or may have several discrete threshold positions to provide an adequate choice of printing flow rates. The flow rate switch is essentially a trigger for the user to generate ink flow, with the degree of pressure or position indicating the rate. The switch may use a pressure transducer that does not move appreciably in response to pressure, such as a strain gauge or piezoelectric device, or it may use a position sensor, such as a spring biased piston or a slider switch.

In an alternative embodiment, the flow rate switch may have a first range than generates ink flow up to fully saturated color of one or two ink colors at a maximum rate, and a second range beyond the first range, in which increasing amounts of the remaining color or colors is added to desaturate and further darken the printed output, up to a composite black color. Such an embodiment would eliminate the need for the color select switch to have a second degree of freedom indicating desaturation or gray level. However, it would not readily permit the printing of light values of desaturated colors, except by large spacings of pen to paper, or by lighter application of the flow rate select switch. In a further alternative embodiment, the flow rate switch may be a simple on-off switch, with printing intensity controlled by the pen-to-paper spacing. The controller may be programmed to provide lighter ink flow in two different ways. First, by reducing the rate at which droplets are emitted, and second, by disabling various nozzles along the length of each nozzle array, such as disabling every nth nozzle, or disabling all but every nth nozzle.

The swath height select switch 22 allows the user to select the width or height of the swath of ink emitted. A typical ink jet pen has an elongated array of nozzles of each ink color. The length of each array serves as a minimum swath width in the absence of the height control. The height control has a range of positions corresponding to a fraction of the arrays that are enabled, ranging between a minimum height optionally as small as a single ink nozzle for fine line drawing, to a full width swath with all nozzles enabled. In a preferred embodiment, the switch is continuously variable, and the controller is programmed to provide any swath height of any number of nozzles.

In a simplified embodiment, the switch may have a limited number of discreet positions, corresponding, for instance, to full height, half height, and quarter height printing. Such fractional height amounts may be best selected based upon the multiplexing scheme used by the pen. For instance, if each array has four "primitives" (conceptually but not spatially corresponding to columns in a matrix), those primitives might be driven as blocks, with the capability of independently addressing any individual nozzle not required, and controller programming simplified.

The pen 26 is a conventional ink jet pen having three ink colors. In alternative embodiments, the pen may have other numbers of ink color, including single colors, or four color pens having black ink in addition to color ink. The printing apparatus may be configured to accept different pen types having the same package size and electrical interface characteristics.

Figure 2:
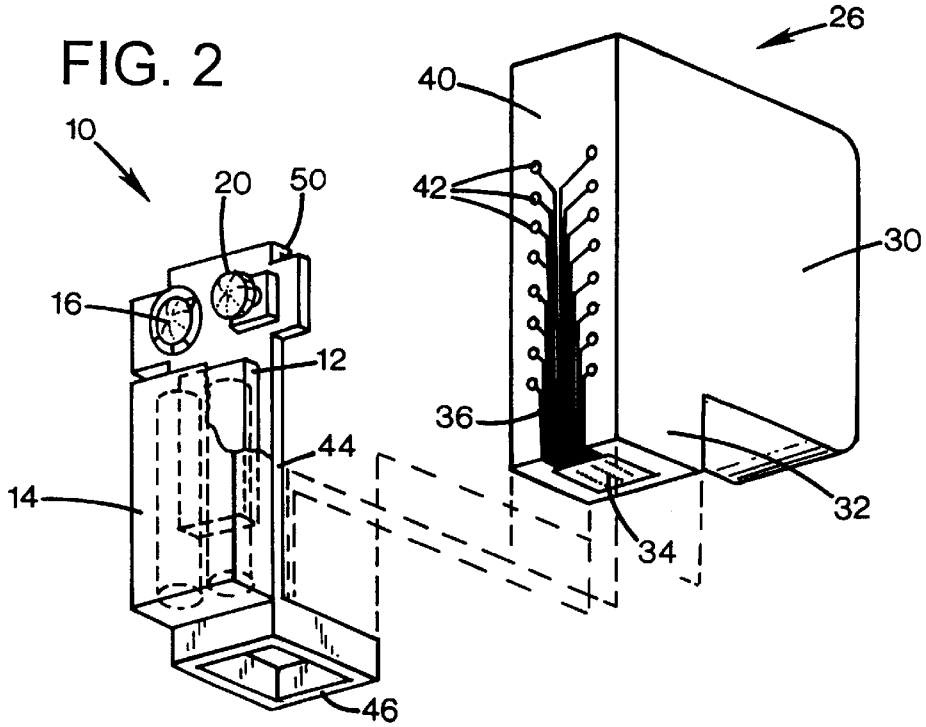
FIG. 2 is an exploded isometric view of the tool of FIG. 1.

FIG. 2 shows the printing apparatus 10 and ink jet pen 26 in a separated state. The pen has a main body 30 in which the ink supply is contained, with a nose portion 32 extending from the body, and a print head 34 connected to the surface of the nose. An electrical connector 36 wraps along one edge face 40 of the pen, and has an array of conductive pads 42, each connected via a conductive trace to the print head. The printing apparatus 10 can take any shape that readily connects to the pen shown, or a different shape for any other type of ink jet pen. As shown, the apparatus has a frame with a vertical panel 44 that overlays the edge face 40 of the pen when installed. At a lower end of the panel, a rectangular loop 46 is configured to closely receive the nose of the pen, and at the upper end of the panel, an angled latch 50 serves to capture the upper edge of the pen to secure the pen and printing apparatus together. The switches 16 and 20 are positioned at the upper end of the panel, and a swath height selection switch 22 is not shown in this embodiment, but may be similarly located. The control circuit 12 is an integrated circuit chip in a carrier mounted to the panel, and batteries 14 are contained in a compartment connected to the panel. At the rear surface of the panel (not shown) a set of conductive contacts is positioned to register with the contacts 42 of the pen. The apparatus includes conductors connecting the contacts, switches, and batteries to the control circuit. These conductors may be in the form of wires, a flexible circuit, a printed circuit board, or suitable alternative means, including conductors formed as part of the body of the apparatus.

Figure 3:
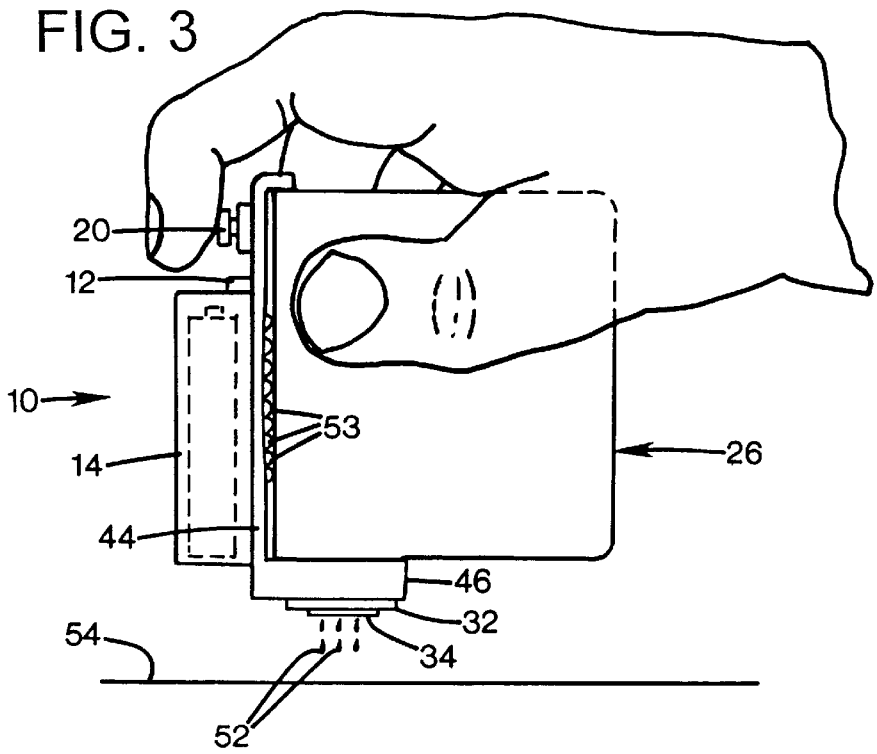
FIG. 3 is a side view of the embodiment of FIG. 1.

FIG. 3 shows the printing apparatus in operation, emitting in droplets 52 onto a sheet of media 54 in response to pressure on the flow rate select switch 20 by a user's finger. The conductive contacts 53 providing electrical connection are shown contacting the corresponding contacts on the pen. The apparatus is entirely self contained, with ink supply and battery power on-board. This avoids the need for power or fluid supply conduits to connect to a remote base. In alternative embodiments where this is not problematic, either power or ink may be supplied from a remote supply.

To generate an image, the user sets the color switch and swath height switch (if applicable) to the desired color and swath height. The pen is positioned over the location where printing is desired, and the trigger or flow rate switch is pressed manually as shown. The user then moves the pen while ink is being emitted to generate a free form pattern corresponding to the motion of the pen. Typically, pen motion is not constrained in any way, and can occur in all three degrees of translational freedom, as well as rotational motion that changes the angle of the nozzle arrays, or the attack angle of the droplets onto the sheet, which may generate a gradient effect. The generated image is formed essentially by the motion of the pen, and not by the controlled selective operation of particular nozzles at particular controlled times, in the manner of a conventional printer.

Figure 4:
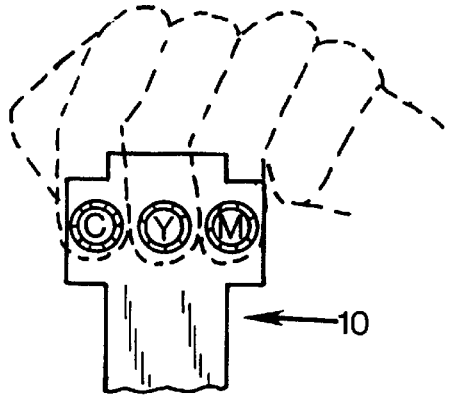
FIG. 4 is a front view of a first alternative embodiment of the invention.

FIG. 4 shows an alternative switch configuration having three switches C, Y, M, each of which corresponds to a particular ink color of the pen (cyan, yellow, magenta). Each switch serves as a flow control or trigger switch for its associated color, so that different colors may be printed by pressing the switches in "chords" or different combinations. With each being a simple on-off switch, 6 colors plus black may be generated; with each switch having intermediate actuation states, either continuously variable or with limited increments, and increased number of colors may be generated by different pressure on or displacement of particular switches.

Figure 5:
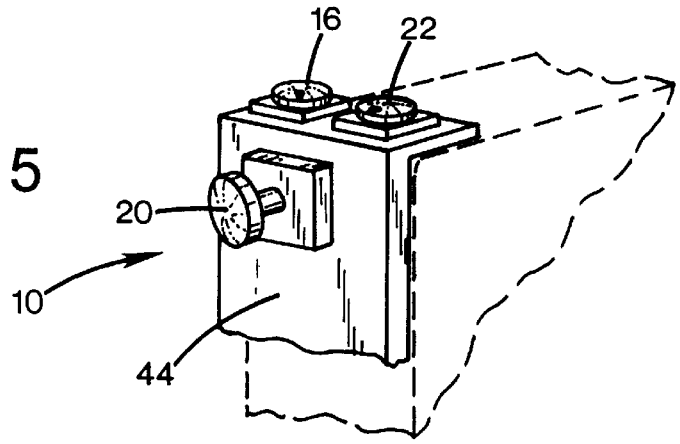
FIG. 5 is an isometric view of a second alternative embodiment of the invention.
Figure 6:
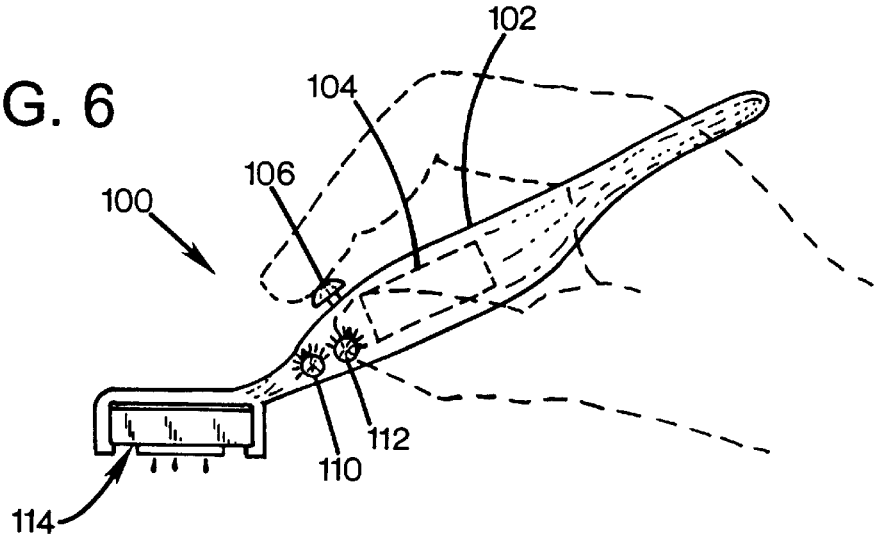
FIG. 6 is a side view of a third alternative embodiment of the invention.

FIG. 5 shows an additional alternative embodiment, with the flow control switch 20 mounted at the front of the panel 44, and the color select switch 16 and swath height switch 22 at the top of the apparatus for ready visibility and control by the user. FIG. 6 shows an alternative configuration of a printing apparatus 100 in which the user holds an elongated body 102 that contains batteries and circuitry 104, with a flow control switch 106 positioned for comfortable control, and swath height and color select switches 110, 112 also accessible. A miniature ink jet pen 114 is connected to the end of the body, with a pocket receiving the pen. A small pen and closely conforming body are selected to provide maximum visibility for the user to see the media sheet being printed.

While the above is discussed in terms of preferred and alternative embodiments, the invention is not intended to be so limited. For instance, special ink pens may be manufactured for particular applications. Water soluble inks may be used for children's projects, with suitable washability instead of the color fastness desired in conventional printer inks. Stencils in common shapes, designs, and characters may be provided in a kit along with a pen to allow a user to create works by painting through the open portions of stencils overlaying the media.

What is claimed is:

1. A painting tool comprising:

a carriage;

an ink jet pen connected to the carriage;

a first control switch on the carriage;

a second control switch on the carriage;

a control circuit on the carriage operably connected to the pen and to the first and second control switches, and wherein the pen includes a plurality of different color inks, and wherein the first control switch is operable to control a first ink flow rate of a first ink color, and the second control switch is operable to control a second ink flow rate of a second ink color.

* * * * *